US009791197B2

(12) United States Patent
Choi et al.

(10) Patent No.: US 9,791,197 B2
(45) Date of Patent: Oct. 17, 2017

(54) REFRIGERATOR WITH REAR PANEL FOR ACCOMMODATING WATER HOSE

(71) Applicant: SAMSUNG ELECTRONICS CO., LTD., Suwon-si, Gyeonggi-do (KR)

(72) Inventors: Nam Gu Choi, Gwangju (KR); Young Gwi Park, Suwon-si (KR); Young Jin Seo, Gwangju (KR); Youn Tae Shin, Gwangju (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 383 days.

(21) Appl. No.: 14/558,132

(22) Filed: Dec. 2, 2014

(65) Prior Publication Data

US 2015/0159934 A1 Jun. 11, 2015

(30) Foreign Application Priority Data

Dec. 6, 2013 (KR) ..... 10-2013-0151586

(51) Int. Cl.
*F25D 3/00* (2006.01)
*F25C 5/00* (2006.01)
(Continued)

(52) U.S. Cl.
CPC ..... *F25C 5/005* (2013.01); *F25D 23/061* (2013.01); *F25D 23/065* (2013.01);
(Continued)

(58) Field of Classification Search
CPC .... F25D 23/068; F25D 23/061; F25D 23/126; F25D 23/06; F25D 23/066; F25D 23/067; F25D 23/065; F25D 2323/061; F25D 2323/06; F25D 2323/0217; F25D 2400/32; F25C 5/005; F25B 40/02
(Continued)

(56) References Cited

U.S. PATENT DOCUMENTS 3,429,140 A * 2/1969 White ..... F25C 5/005 62/339
4,543,800 A * 10/1985 Mawby ..... E05D 11/0081 439/165
(Continued)

FOREIGN PATENT DOCUMENTS

DE 3024590 1/1982
EP 1484563 12/2004
(Continued)

OTHER PUBLICATIONS

Partial European Search Report dated Jul. 30, 2015 from European Patent Application No. 14195925.4, 6 pages.

*Primary Examiner* — David Teitelbaum
(74) *Attorney, Agent, or Firm* — Staas & Halsey LLP

(57) ABSTRACT

A rear plate of a refrigerator includes a base section formed at the outside of the rear plate while being flat, and a formed section formed to protrude from the base section toward the inner case through a foaming process. Outer equipment is installed at the formed section, to be disposed more inside than the base section and, as such, it is possible to protect the outer equipment from external impact. In addition, it is possible to achieve an improvement in rear appearance design of the refrigerator and an enhancement in space utility of the refrigerator.

24 Claims, 9 Drawing Sheets

(51) Int. Cl.
*F25D 23/12* (2006.01)
*F25D 23/06* (2006.01)
*F25B 40/02* (2006.01)

(52) U.S. Cl.
CPC ..... *F25D 23/126* (2013.01); *F25B 40/02* (2013.01); *F25D 23/06* (2013.01); *F25D 23/066* (2013.01); *F25D 23/067* (2013.01); *F25D 23/068* (2013.01); *F25D 2323/06* (2013.01); *F25D 2323/061* (2013.01); *F25D 2400/32* (2013.01)

(58) Field of Classification Search
USPC ..... 62/389
See application file for complete search history.

(56) References Cited

U.S. PATENT DOCUMENTS

| | | | | |
|---|---|---|---|---|
| 2011/0132023 | A1* | 6/2011 | Hwang | F25D 23/065 62/449 |
| 2011/0232323 | A1* | 9/2011 | Morris | F25D 11/00 62/457.9 |

FOREIGN PATENT DOCUMENTS

| | | |
|---|---|---|
| JP | 2766436 | 6/1998 |
| JP | 3704250 | 10/2005 |
| KR | 1999-0016342 | 5/1999 |
| KR | 10-2007-0043073 | 4/2007 |
| KR | 10-2010-0085241 | 7/2010 |
| KR | 10-2010-0085262 | 7/2010 |
| KR | 10-0975026 | 8/2010 |
| WO | WO 2009/035172 | 3/2009 |

* cited by examiner

REFRIGERATOR WITH REAR PANEL FOR ACCOMMODATING WATER HOSE

CROSS-REFERENCE TO RELATED APPLICATIONS

This application claims the benefit of Korean Patent Application No. 10-2013-0151586, filed on Dec. 6, 2013 in the Korean Intellectual Property Office, the disclosure of which is incorporated herein by reference.

BACKGROUND

1. Field

Embodiments disclosed herein relate to a structure of a rear plate included in an outer case of a refrigerator.

2. Description of the Related Art

Generally, a refrigerator refers to an electronic appliance (e.g., for home or commercial use) and may include a body, a storage chamber defined in the body (e.g., to store food), and a cold air supplier to supply cold air to the storage chamber in order to maintain a desired temperature (e.g., to keep the food fresh).

Generally, the body of such a refrigerator may include an inner case to define a storage chamber, an outer case coupled to the inner case at an outside of the inner case, to define an appearance of the refrigerator, and an insulator disposed between the inner case and the outer case. The inner case may be formed through injection molding of a resin material, whereas the outer case may be formed through pressing of an iron plate material. Urethane foam may be used for the insulator. In this case, the insulator may be formed by injecting a foamable liquid urethane between the inner case and the outer case in an assembled state of the inner and outer cases, and foaming the liquid urethane.

The outer case may include a top plate, opposite side plates, a bottom plate, and a rear plate. Outer equipment required for additional functions of the refrigerator or convenient use of the refrigerator may be installed at an outer surface of the rear plate. For example, a water supply hose to connect a water bucket and an ice maker may be installed at the rear surface of the rear plate.

When the water bucket and ice maker are installed within the storage chamber, the water supply hose may form a portion of a water supply line extending from the water bucket in the storage chamber to the ice maker in the storage chamber after passing through the interior of the body, passing around the body, and then again passing through the interior of the body.

The structure in which the water supply hose is disposed outside the rear plate may be more advantageous than the structure in which the water supply hose is disposed between the inner case and the outer case. This is because, in the structure in which the water supply hose is disposed between the inner case and the outer case, the position of the water supply hose may be varied or the water supply hose itself may be damaged due to foaming pressure generated upon injecting a foamable liquid urethane between the inner case and the outer case and foaming the liquid urethane.

Of course, the structure in which the water supply hose is disposed outside the rear plate also has disadvantages. That is, the water supply hose may be damaged due to external physical impact because the water supply hose is disposed outside the rear plate and, as such, is externally exposed. Furthermore, an appearance may be degraded. Since the water supply hose is disposed outside the rear plate, an additional installation space may also be required for the water supply hose. In addition, it may be difficult to neatly arrange and fix the water supply hose.

Such disadvantages may also be encountered in outer equipment such as a connecting tube protruding outward from the rear plate to connect the water supply hose, an electric equipment box to receive electric equipment for control of operation of the refrigerator, and handles for movement of the refrigerator.

SUMMARY

Therefore, it is an aspect of the disclosure to provide a refrigerator capable of (suitable for, adapted to, configured to, arranged to, etc.) protecting outer equipment installed at an outer surface of a rear plate of an outer case from external physical impact, and achieving an improvement in appearance design and an enhancement in space utility.

Additional aspects of the disclosure will be set forth in part in the description which follows and, in part, will be apparent from the description, or may be learned by practice of the disclosure.

In accordance with an aspect of the disclosure, a refrigerator may include an inner case, an outer case coupled to an outside of the inner case, the outer case including a rear plate to define a rear appearance of the refrigerator, an insulator provided between the inner case and the outer case, a storage chamber defined in the inner case, and outer equipment installed at an outside of the rear plate. The rear plate may include a base section formed at the outside of the rear plate while being substantially flat, and a formed section formed to protrude from the base section toward the inner case through a foaming process, the outer equipment being installed at the formed section, to be disposed more inside than the base section (e.g., the outer equipment may be installed at the formed section such that the outer equipment is disposed between the formed section and the base section).

The rear plate may be made of an iron plate material.

The outer equipment may include a water supply hose to supply water.

The refrigerator may further include a water supply unit provided at the storage chamber, to supply water, and a water retrieval unit to receive water from the water supply unit, wherein the water supply hose supplies water from the water supply unit to the water retrieval unit.

For example, the water supply unit may include a water bucket provided at the storage chamber, to store water and to cool the stored water.

The water retrieval unit may include an ice maker or a dispenser.

The refrigerator may further include a fixer coupled to the formed section, to fix the water supply hose.

The fixer may include a support groove to support the water supply hose.

The fixer may be coupled to the formed section by a fastening member.

The formed section may include a fastening hole, to which the fastening member is fastened.

The outer equipment may include a connecting tube extending through the inner case, the insulator, and the rear plate, for connection of the water supply hose to the connecting tube.

The formed section may be formed with a connecting tube installation hole extending through the formed section, for installation of the connecting tube at the formed section.

The outer equipment may include an electric equipment box to receive electric equipment for control of operation of the refrigerator.

The formed section may be formed with an electric equipment box installation hole extending through the formed section, for installation of the electric equipment box at the formed section.

The outer equipment may include a handle for movement of the refrigerator.

The formed section may be formed with a handle installation hole extending through the formed section, for installation of the handle at the formed section.

In accordance with an aspect of the disclosure, a refrigerator may include an inner case, an outer case coupled to an outside of the inner case, the outer case including a rear plate to define a rear appearance of the refrigerator, an insulator provided between the inner case and the outer case, a storage chamber defined in the inner case, a water supply unit provided at the storage chamber, a water retrieval unit to receive water from the water supply unit, and a water supply hose installed at an outside of the rear plate, to supply water from the water supply unit to the water retrieval unit. The rear plate may include a base section, an introduction-side connecting tube installation portion formed to protrude from the base section toward the inner case, for installation of an introduction-side connecting tube, the water supply hose being connected, at one end thereof, to the introduction-side connecting tube, a discharge-side connecting tube installation portion formed to protrude from the base section toward the inner case, for installation of a discharge-side connecting tube, the water supply hose being connected, at the other end thereof, to the discharge-side connecting tube, and a guide formed to protrude from the base section toward the inner case, the guide connecting the introduction-side connecting tube installation portion and the discharge-side connecting tube installation portion.

The water supply hose connected to the introduction-side connecting tube and the discharge-side connecting tube may be disposed in the guide between the inner case and the base section.

In accordance with an aspect of the disclosure, a refrigerator may include an inner case, an outer case coupled to an outside of the inner case, the outer case including a rear plate to define a rear appearance of the refrigerator, an insulator provided between the inner case and the outer case, a storage chamber defined in the inner case, a water supply unit provided at the storage chamber, a water retrieval unit to receive water from the water supply unit, and a water supply hose installed at an outside of the rear plate, to supply water from the water supply unit to the water retrieval unit. The rear plate may include a base section formed at the outside of the rear plate while being substantially flat, and a formed section formed to protrude from the base section toward the inner case, the water supply hose being installed at a guide formed in the formed section, to be disposed more inside than the base section, (e.g., the water hose may be installed at the guide such that the water hose is disposed between the guide and the base section). A fixer may be coupled to the guide, to fix the water supply hose.

In accordance with an aspect of the disclosure, a refrigerator may include an inner case, an outer case coupled to an outside of the inner case, the outer case comprising a rear plate to define a rear appearance of the refrigerator, and a storage chamber defined in the inner case. The rear plate may include a substantially flat base section formed at the outside of the rear plate, and a formed section which is indented from the base section toward the inner case. Outer equipment installed at the formed section may be disposed such that a distance between the inner case and the outer equipment is less than a distance between the inner case and the base section.

The outer equipment may include a water hose, and the formed section may be formed to include a first mounting portion in which one end of the water hose is installed, a second mounting portion in which the other end of the water hose is installed, and a guide which connects the first mounting portion and the second mounting portion, in which the water hose is disposed between the first mounting portion and the second mounting portion.

The outer equipment may further include electric equipment and a handle, and the formed section may be further formed to include an electric equipment mounting portion in which the electric equipment is disposed and a handle mounting portion in which the handle is disposed.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
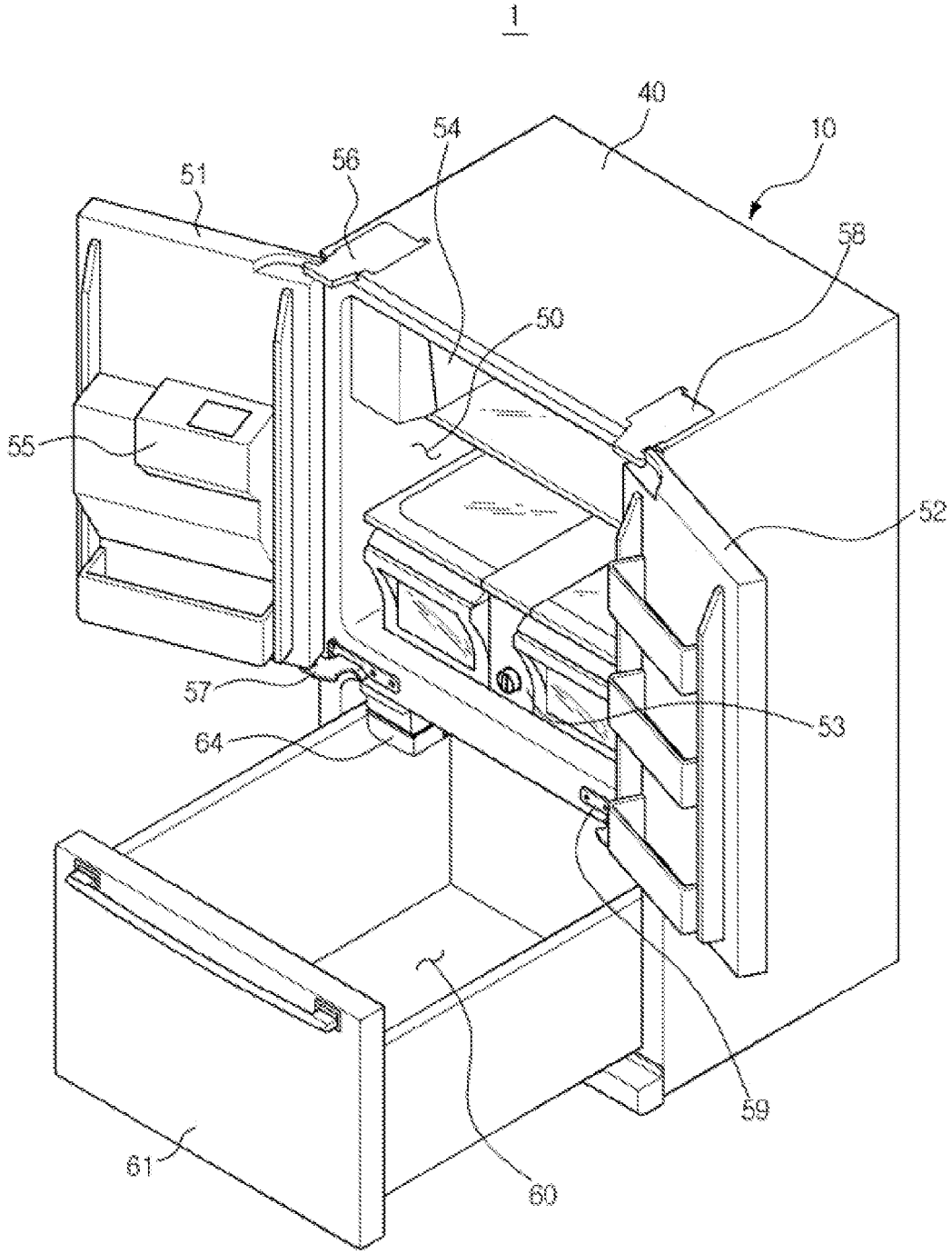
FIG. 1 is a view illustrating the entire appearance of a refrigerator according to an embodiment of the disclosure.

Reference will now be made in detail to embodiments of the disclosure, examples of which are illustrated in the accompanying drawings, wherein like reference numerals refer to like elements throughout. The embodiments are described below to explain the disclosure by referring to the figures.

Figure 2:
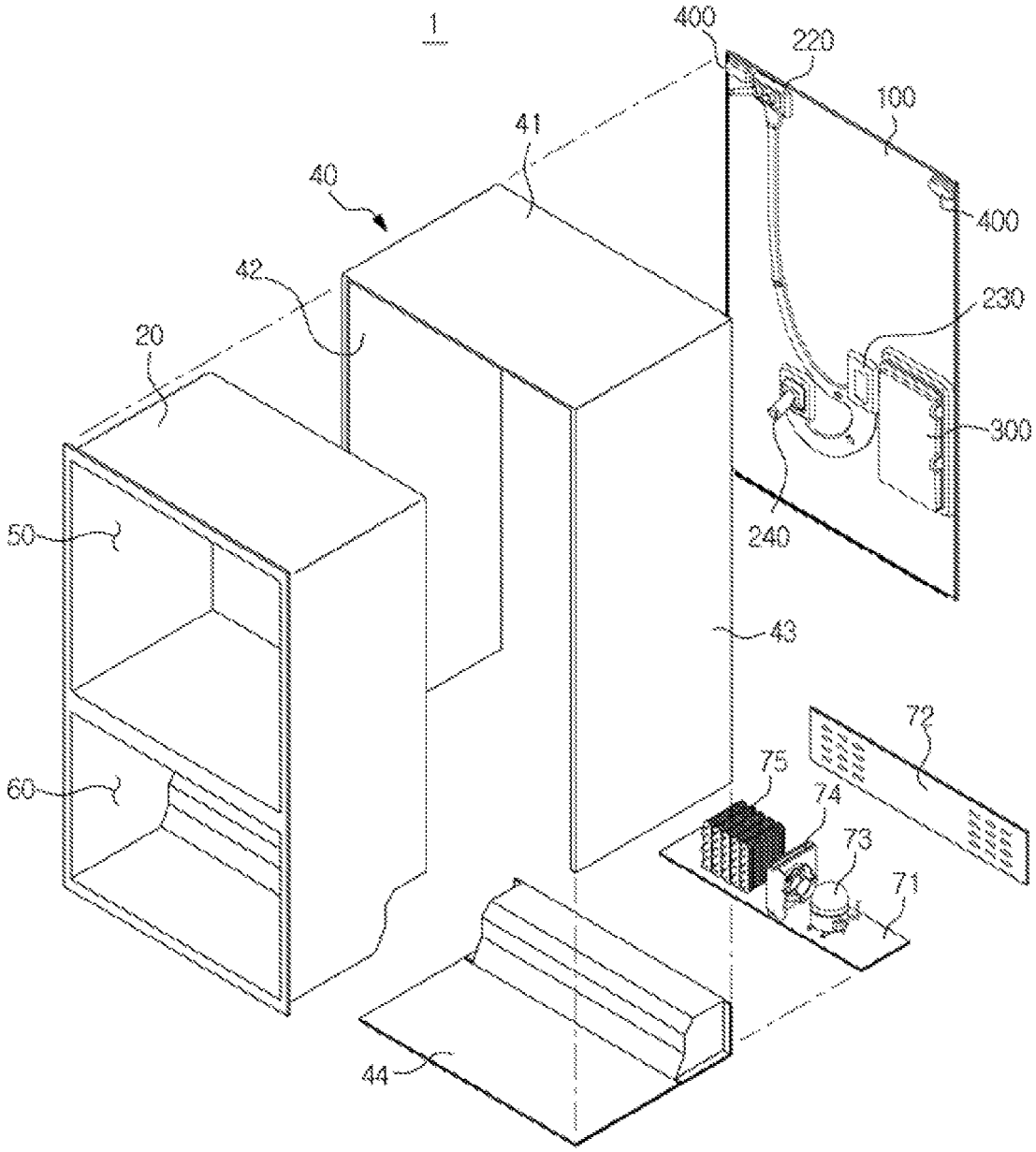
FIG. 2 is a view illustrating a body of the refrigerator of FIG. 1 in an exploded state.

FIG. 1 is a view illustrating the entire appearance of a refrigerator according to an embodiment of the disclosure. FIG. 2 is a view illustrating a body of the refrigerator of FIG. 1 in an exploded state.

Referring to FIG. 1, the refrigerator, which is designated by reference numeral "1", may include a body 10, and a storage chamber 50, 60 defined in the body 10. The refrigerator 1 may further include a cold air supplier to supply air to the storage chamber 50-60.

The body 10 may be formed to have a substantially box shape. The body 10 may include an inner case 20 to define the storage chamber 50, 60, an outer case 40 coupled to the inner case 20 at an outside of the inner case 20, to define an appearance of the refrigerator 1, and an insulator 30 (FIG. 7) disposed between the inner case 20 and the outer case 40, to insulate the storage chamber 50, 60.

The inner case 20 may be formed through injection molding of a resin material, whereas the outer case 40 may be formed through pressing of an iron plate material. A urethane foam may be used for the insulator. In this case, the insulator may be formed by injecting a foamable liquid urethane between the inner case 20 and the outer case 40 in an assembled state of the inner and outer cases 20 and 40, and foaming the liquid urethane.

The outer case 40 may include a top plate 41 to define a top appearance of the refrigerator 1, opposite side plates 42 and 43 to define side appearances of the refrigerator 1, a bottom plate 44, and a rear plate 100 to define a rear appearance of the refrigerator 1. The top plate 41, opposite side plates 42 and 43, and rear plate 100 may be substantially flat.

In an example embodiment, the top plate 41 and opposite side plates 42 and 43 may be integrally formed. Of course, the opposite side plates 42 and 43 may be integrated with the bottom plate 44, and the top plate 41 may be separately formed, differently than the example embodiment.

A machinery chamber bottom plate 71 may be provided beneath the bottom plate 44. The bottom plate 44 and machinery chamber bottom plate 71 may define a machinery chamber, in which constituent elements of the cold air supplier are disposed. In the machinery chamber, a compressor 73, a blowing fan 74, a condenser 75, etc. may be disposed. The machinery chamber may be opened or closed by a machinery chamber cover 72 to access the constituent elements disposed in the machinery chamber.

Installed at the rear plate 100 may be connecting tubes 220, 230, and 240, to which water supply hoses 211, 212, and 213 (FIG. 3) are connected, an electric equipment box 300, in which electric equipment for control of operation of the refrigerator 1 is received, and one or more handles 400 for movement of the refrigerator 1. This will be described later.

The storage chamber 50, 60 may include an upper storage chamber 50 and a lower storage chamber 60. The upper storage chamber 50 may be a refrigerating compartment, whereas the lower storage chamber 60 may be a freezing compartment. The upper storage chamber 50 may be provided with a water bucket 53 to cool and store water. The water bucket 53 may cool water stored therein, using cold air present in the upper storage chamber 50. In an alternative embodiment, the upper storage chamber 50 may be a freezing compartment and the lower storage chamber may be a refrigerating compartment. In the alternative embodiment, the water bucket may be provided in the lower storage chamber.

An ice making chamber 54 may be provided at one corner of the upper storage chamber 50. The ice making chamber 54 may be partitioned from the upper storage chamber 50 in an insulated state. The ice making chamber 54 may be cooled independently of the upper storage chamber 50. An upper ice maker (not shown) to make ice may be disposed in the ice making chamber 54. The upper ice maker may make ice, using water supplied from the water bucket 53.

A lower ice maker 64 to make ice may also be provided at the lower storage chamber 60. The lower ice maker 64 may make ice, using cold air present in the lower storage chamber 60. The lower ice maker 64 may make ice, using water supplied from the water bucket 53.

Although a plurality of ice makers may be provided at the refrigerator according to an embodiment, as described above, embodiments of the disclosure are not limited thereto. For example, only one ice maker may be provided.

Each of the upper and lower storage chambers 50 and 60 is open at a front side thereof, for storage and retrieval of food. The open front sides of the upper and lower storage chambers 50 and 60 may be opened or closed by doors 51 and 52, and a door 61. In alternative embodiments, the refrigerator may include various numbers of doors (e.g., according to a style of the refrigerator). For example, the refrigerator may include one door for each of the upper storage chamber and lower storage chamber, one door total to access the upper storage chamber and lower storage chamber, two doors for each of the upper storage chamber and the lower storage chamber, etc.

The upper storage chamber 50 may be opened or closed by a pair of hinge doors, namely, the doors 51 and 52. That is, the hinge doors 51 and 52 may be pivotably coupled to the body 10 by hinge members 56, 57, 58, and 59. The lower storage chamber 60 may be opened or closed by a sliding door, namely, the door 61, which may be slidably extendable from or retractable into the interior of the body 10. In alternative embodiments, the refrigerator may include other hinge arrangements according to the number of doors, and the rotation direction of each door. The location of the hinges would be understood by one of ordinary skill in the art (for example, depending on whether the door is slidable, rotates in a left-to-right or right-to-left direction, etc.).

A dispenser 55 may be provided at the door 51 of the upper storage chamber 50, to allow the user to take water stored in the water bucket 53 or ice made by the upper ice maker out of the refrigerator 1 from outside of the refrigerator 1 without opening the doors 51 and 52.

Meanwhile, the refrigerator 1 may further include a water supply line (not shown) to connect the water bucket 53 and the dispenser 55, to connect the water bucket 53 and the upper ice maker, and to connect the water bucket 53 and the lower ice maker 64.

That is, when it is assumed that the water bucket 53 is a water supply unit, and the upper ice maker, the lower ice maker 64, or the dispenser 55 is a water retrieval unit, the water supply line connects the water supply unit and the water retrieval unit in order to supply water from the water supply unit to the water retrieval unit.

In an embodiment of the disclosure, the water supply line may extend from each of the storage chambers 50 and 60, and is then connected to the storage chambers 50 or 60 after passing through the insulator 30 and the rear plate 100 in this order, passing around an outside of the rear plate 100, and then passing through the rear plate 10, the insulator 30, and the inner case 20 in this order.

In detail, the water supply line may include connecting tubes 220, 230, and 240 each extending through the inner case 20, insulator 30, and rear plate 100 while having an inner end exposed inside an associated one of the storage chambers 50 and 60 and an outer end exposed outside the rear plate 100, inner hoses (not shown) connected to associated ones of the inner ends of the connecting tubes 220, 230, and 240, respectively, and water supply hoses 211, 212, and 213 (FIG. 3) disposed outside the rear plate 10, to be connected to associated ones of the outer ends of the connecting tubes 220, 230, and 240, respectively.

The structure in which the water supply hoses 211, 212, and 213 are installed outside the rear plate 100, as described above, has advantageous effects in that the water supply hoses 211, 212, and 213 are prevented from being damaged by foaming pressure generated upon foaming the insulator 30, as compared to the structure in which the water supply hoses 211, 212, and 213 are installed between the inner case 30 and the outer case 40.

In addition, the refrigerator according to an embodiment of the disclosure may have a foaming structure of the rear plate 100, which is capable of (suitable for, adapted to, configured to, arranged to, etc.) preventing the water supply hose 211, 212, and 213 from being exposed to external physical impact, achieving an improvement in appearance design through neat arrangement of the water supply hose 211, 212, and 213, and achieving an enhancement in space utility through prevention of the water supply hose 211, 212, and 213 from protruding outward from the rear plate 100. Hereinafter, a foamed structure of the rear plate 100 according to an embodiment of the disclosure will be described.

Figure 3:
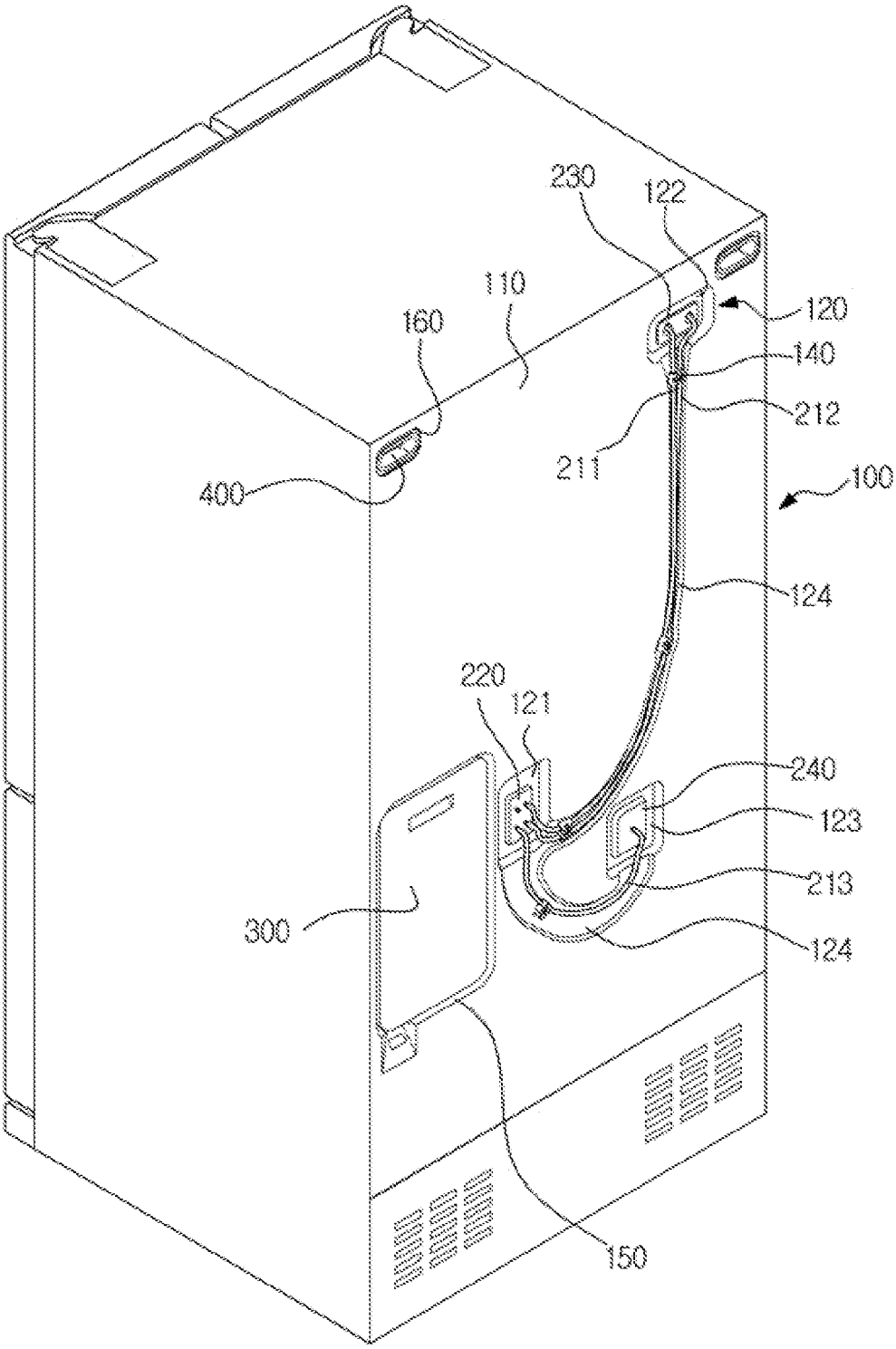
FIG. 3 is a view illustrating a rear appearance of the refrigerator illustrated in FIG. 1.
Figure 4:
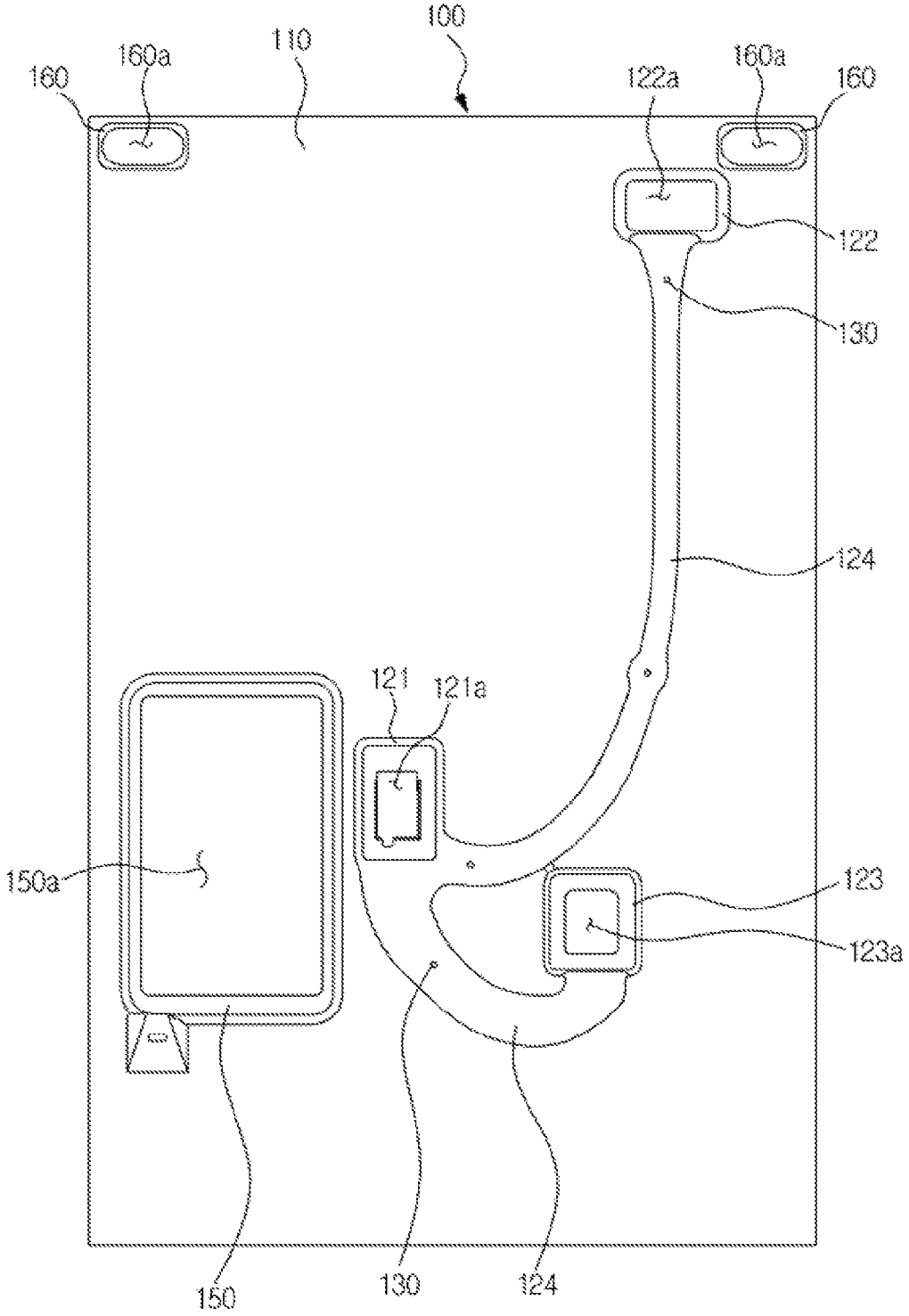
FIG. 4 is a view illustrating a rear plate of the refrigerator illustrated in FIG. 1.
Figure 5:
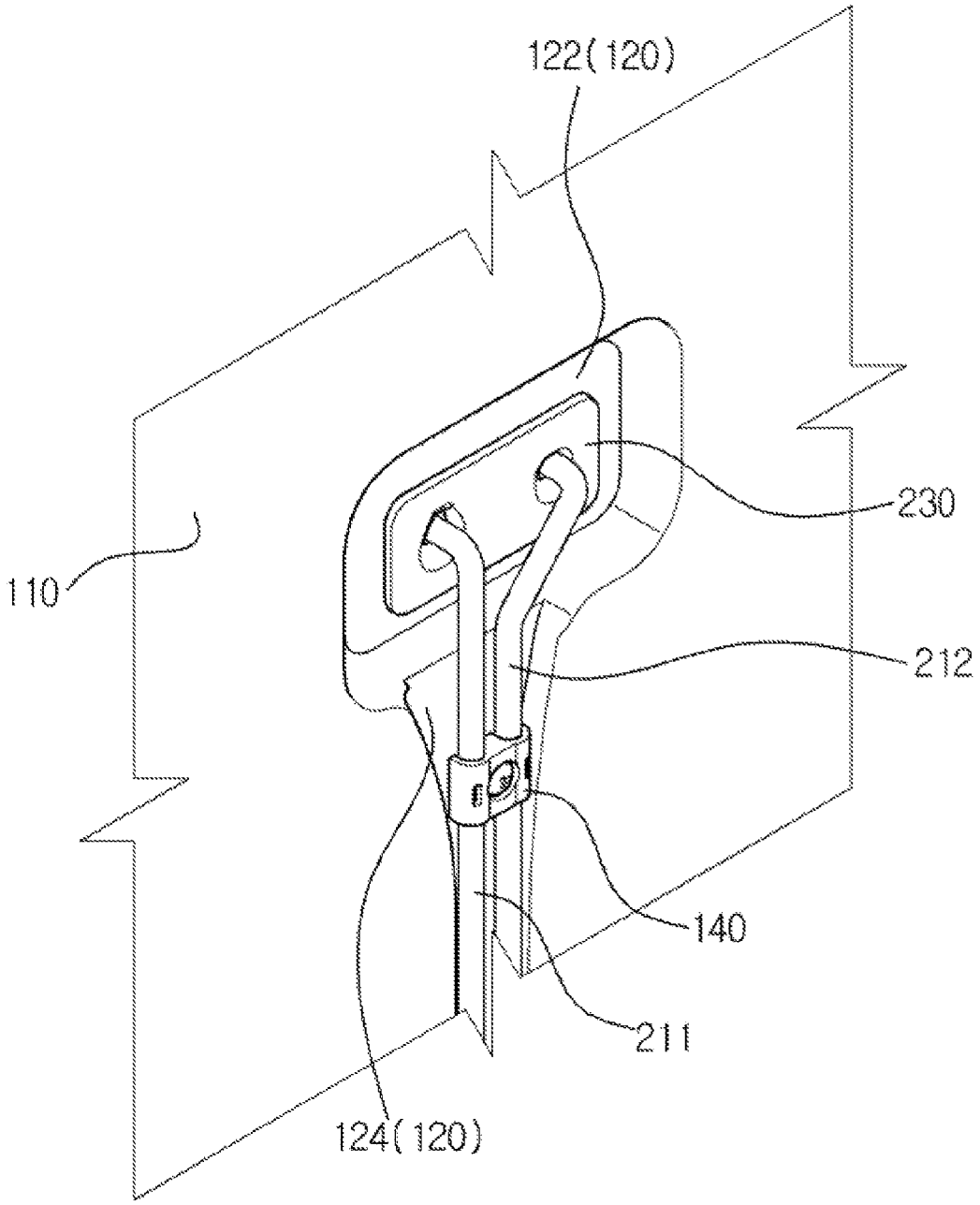
FIG. 5 is an enlarged view illustrating a portion of a formed section of the rear plate in the refrigerator of FIG. 5.
Figure 6:
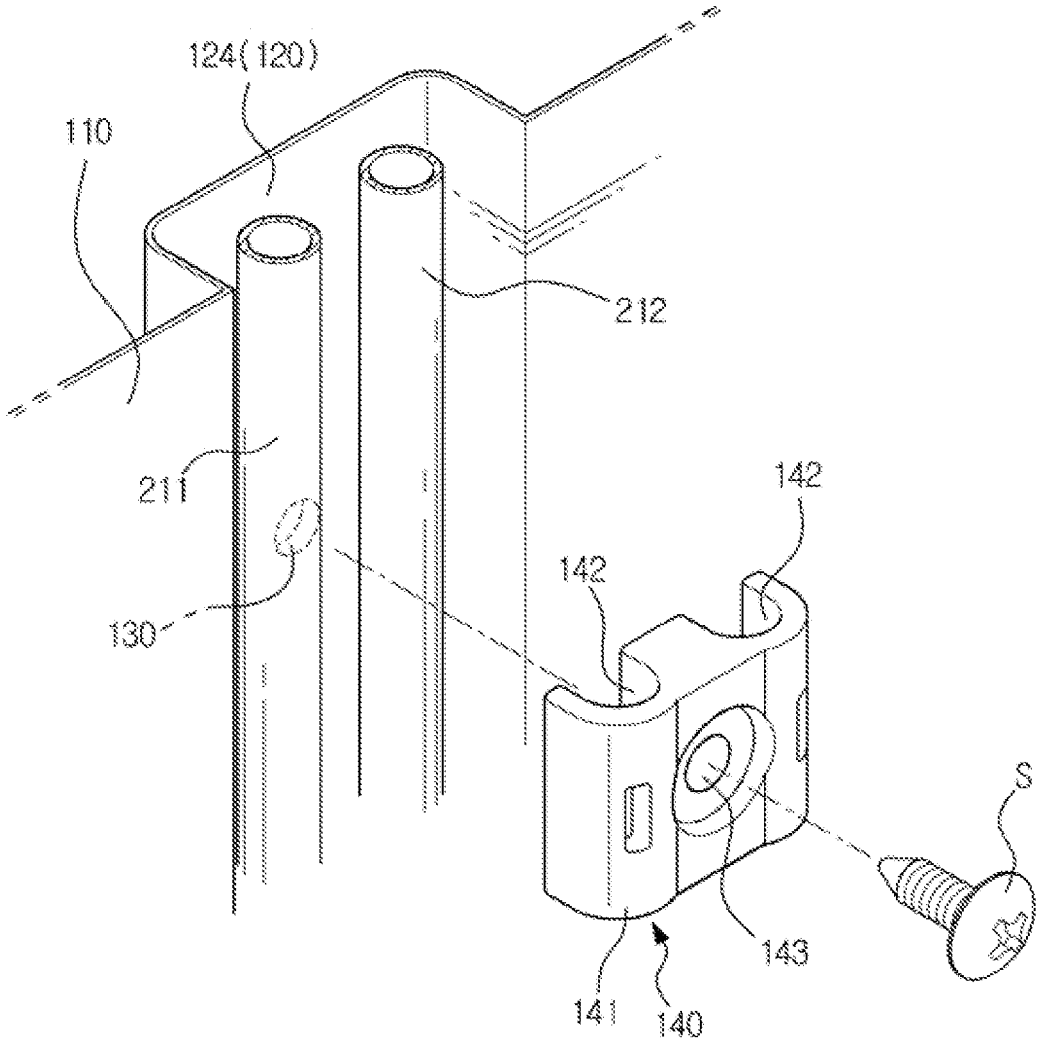
FIG. 6 is a view explaining a structure of a fixer in the refrigerator of FIG. 1.
Figure 7:
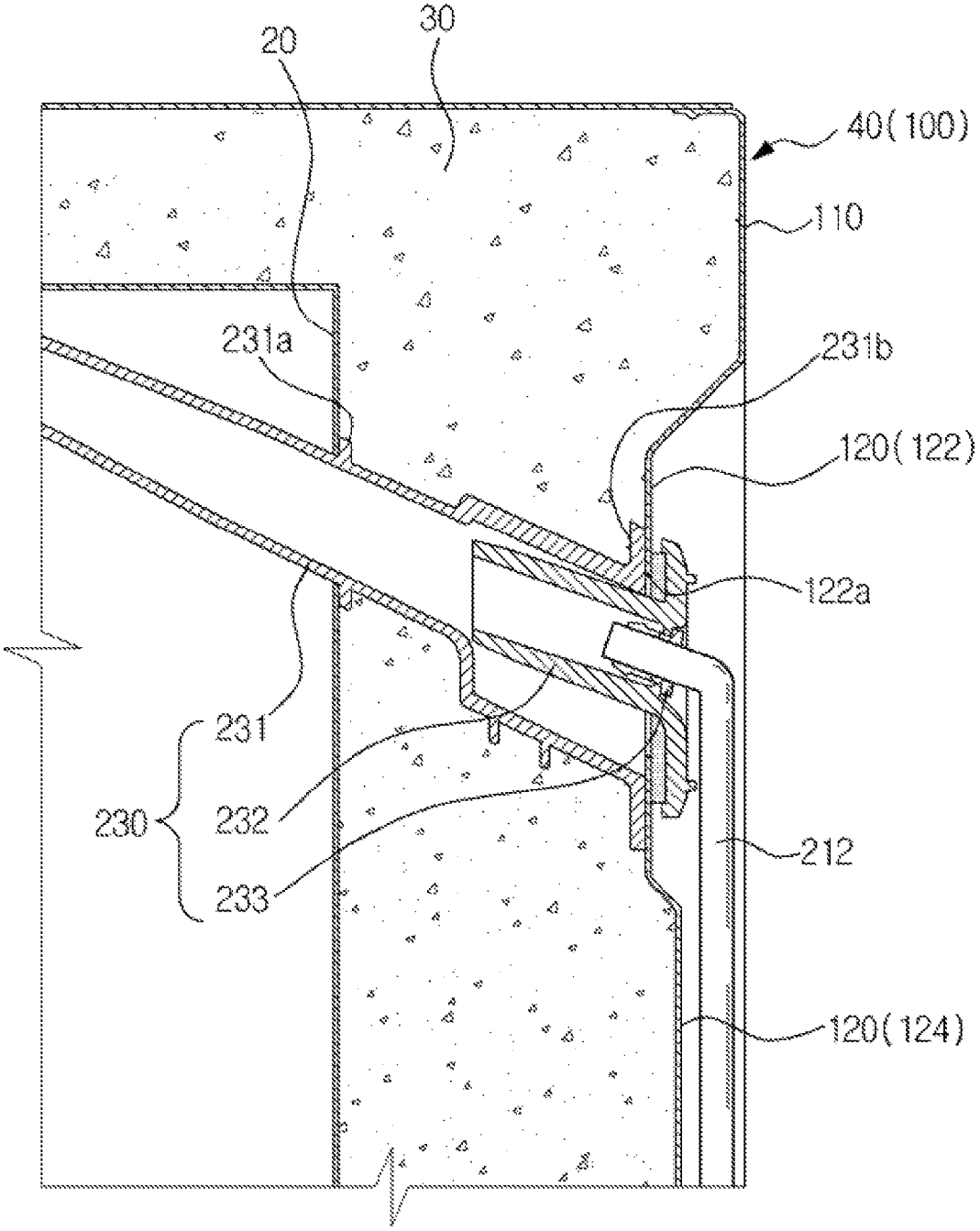
FIG. 7 is a sectional view explaining a structure in which water supply hoses are connected to the formed section of the rear plate in the refrigerator of FIG. 1, in particular, a structure in which water supply hoses are connected to an upper discharge-side connecting tube of the formed section.

FIG. 3 is a view illustrating a rear appearance of the refrigerator illustrated in FIG. 1. FIG. 4 is a view illustrating the rear plate of the refrigerator illustrated in FIG. 1. FIG. 5 is an enlarged view illustrating a portion of a formed section of the rear plate in the refrigerator of FIG. 5. FIG. 6 is a view explaining a structure of a fixer in the refrigerator of FIG. 1. FIG. 7 is a sectional view explaining a structure in which the water supply hoses are connected to the formed section of the rear plate in the refrigerator of FIG. 1.

Referring to FIGS. 1 to 7, in accordance with an embodiment of the disclosure, the rear plate 100 of the refrigerator 1 may include a base section 110 formed at an outside of the rear plate 100, and a formed section 120 formed to protrude from the base section 110 toward the inner case 20. That is, the formed section 120 may be indented or recessed with respect to the base section 110.

The base section 110 may be substantially flat. Of course, small irregular structures (not shown) may be formed at the base section 110, for reinforcement. Such irregularly shaped structures may be distinguished from the formed section 120 according to an embodiment of the disclosure, in that it may be impossible to mount outer equipment to the base section 110 due to the size and shape of the irregularly shaped structures.

The rear plate 100 may be made of an iron plate material. The formed section 120 may be formed through a forming process subjected to the rear plate 100. In this case, the forming process may include pressing of an iron plate. That is, the formed section 120 may be formed simultaneously with the rear plate 100 when the rear plate 100 is formed through pressing of an iron plate material. Accordingly, formation of the formed section 120 may result in a reduced cost and time, as compared to conventional cases.

Outer equipment may be installed at the formed section 120. In an embodiment of the disclosure, outer equipment refers to accessories installed at an outside of the body 10, for particular functions of the refrigerator 1 or convenient use of the refrigerator 1.

For example, the outer equipment may include the water supply hoses 211, 212, and 213 to supply water, and the connecting tubes 220, 230, and 240 exposed outside of the body 10, for connection of the water supply hoses 211, 212, and 213 thereto. However, the disclosure is not limited thereto, and the number of water supply hoses, connecting tubes, and connecting tube mounting portions may be different (e.g., more or less) than that shown in the figures. For example, the number of water supply hoses, connecting tubes, and connecting tube mounting portions may be different depending on the number and/or location of ice makers, water dispensers, water buckets, etc., which are disposed in the refrigerator.

Each of the connecting tubes 220, 230, and 240 may extend through the body 10. For example, each of the connecting tubes 220, 230, and 240 may extend through the inner case 20, insulator 30, and rear plate 100. Inner ends of the connecting tubes 220, 230, and 240 may be disposed inside associated ones of the storage chambers 50 and 60, whereas outer ends of the connecting tubes 220, 230, and 240 may be disposed outside the rear plate 100.

In an embodiment, the connecting tubes 220, 230, and 240 may correspond to an introduction-side connecting tube, an upper discharge-side connecting tube, and a lower discharge-side connecting tube, respectively.

The inner end of the introduction-side connecting tube 220 may be connected to the water bucket 53, to receive water from the water bucket 53. The inner end of the upper discharge-side connecting tube 230 may be connected to the dispenser 55 and upper ice maker, to supply water to the dispenser 55 and upper ice maker. The inner end of the lower discharge-side connecting tube 240 may be connected to the lower ice maker 64, to supply water to the lower ice maker 64.

The water supply hoses 211, 212, and 213 may be a first water supply hose, a second water supply hose, and a third water supply hose, respectively.

The first water supply hose 211 may connect the outer end of the introduction-side connecting tube 220 and the outer end of the upper discharge-side connecting tube 230, to supply water from the water bucket 53 to the dispenser 55. The second water supply hose 212 may connect the outer end of the introduction-side connecting tube 220 and the outer end of the upper discharge-side connecting tube 230, to supply water from the water bucket 53 to the upper ice maker. The third water supply hose 213 may connect the outer end of the introduction-side connecting tube 220 and the outer end of the lower discharge-side connecting tube 240, to supply water from the water bucket 53 to the lower ice maker 64.

The formed section 120 of the rear plate 100 in the refrigerator 1 according to an embodiment of the disclosure may include connecting tube mounting portions 121, 122, and 123, to which the connecting tubes 220, 230, and 240 may be mounted, and a guide 124, at which the water supply hoses 211, 212, and 213 may be installed. Thus, the connecting tube mounting portions 121, 122, and 123 and connecting tubes 220, 230, and 240, and the guide 124, may be indented or recessed with respect to the base section 110.

In particular, the connecting tubes 220, 230, and 240 may be installed to pass through the formed section 120. To this end, mounting holes 121*a*, 122*a*, and 123*a* may be formed through the connecting tube mounting portions 121, 122, and 123, respectively.

The guide 124 may be provided to connect the connecting tube mounting portions 121, 122, and 123, and to guide the water supply hoses 211, 212, and 213.

The guide 124 may also function to fix the water supply hoses 211, 212, and 213. To this end, the refrigerator 1 may further include fixers 140 (FIG. 5) coupled to the guide 124 in order to fix the water supply hoses 211, 212, and 213. As shown in FIGS. 4 and 5, a first guide may extend from connecting tube mounting portion 121 to connecting tube mounting portion 122, and a second guide may extend from connecting tube mounting portion 121 to connecting tube mounting portion 123. Water supply hose 211 and water supply hose 212 may be disposed in the first guide, while water supply hose 213 may be disposed in the second guide.

Each fixer 140 may be formed through injection molding of a resin material. Each fixer 140 may include a fixer body 141, and support grooves 142 formed at the fixer body 141, to hold the water supply hoses 211 and 212, respectively.

Each fixer 140 may be coupled to the formed section 120 in a state of holding the water supply hoses 211 and 212. Each fixer 140 may be firmly fastened to the formed section 120 by one or more fastening members S. Each fastening member S may include a screw, a bolt, a pin, a rivet, an anchor, an adhesive, or the like.

For fastening of each fixer 140, fastening holes 143 and 130 may be formed through the fixer 140 and formed section 120, respectively. Fastening members S are fastened to the fastening holes 143 and 130, respectively.

Since the water supply hoses 211, 212, and 213 are installed at the formed section 120, and are fixed by the fixer 140, it may be possible to achieve easy arrangement of the water supply hoses 211, 212, and 213 and an enhancement in appearance.

The connecting tubes 220, 230, and 240 installed at the formed section 120 and the water supply hoses 211, 212, and 213 may be disposed more inside than the base section 110. That is, the connecting tubes 220, 230, and 240 and the water supply hoses 211, 212, and 213 may not protrude more outward than the base section 110.

Conventional refrigerators which simply include a flat rear plate require an additional installation space corresponding to a protrusion length of outer equipment. However, the refrigerator according to the example embodiments of the disclosure does not require an additional installation space and, as such, an enhancement in space utility is achieved.

Hereinafter, a structure in which the water supply hoses 211, 212, and 213 are coupled to the formed section 120 of the rear plate 100 will be further described with reference to FIG. 7.

Since coupling structures of the connecting tube mounting portions 121, 122, and 123 for the water supply hoses 211, 212, and 213 are similar, the following description will be given only in conjunction with the coupling structure of the connecting tube mounting portion 122 for the water supply hose 212.

As illustrated in FIG. 7, the upper discharge-side connecting tube 230 may include an inner connecting tube 231, an outer connecting tube 232, and a hose sealing member 233. An inner end of the inner connecting tube 231 (not shown) may be connected to the upper ice maker.

The inner connecting tube 231 may include an inner case engagement protrusion 231*a* to be supported by an outer surface of the inner case 20, and an outer case engagement protrusion 231*b* to be supported by an inner surface of the rear plate 100.

Accordingly, the inner connecting tube 231 may be disposed to extend through the inner case 20, insulator 30, and rear plate 100 while being firmly supported by the outer surface of the inner case 20, the inner surface of the rear plate 100, and the insulator 30. The inner connecting tube 231 also prevents a foamable liquid urethane from leaking inwardly of the inner case 20 and outwardly of the rear plate 100 during foaming of the liquid urethane.

The outer connecting tube 232 may be connected to the inner connecting tube 231. A portion of the outer connecting tube 232 may be exposed outside the formed section 120 of the rear plate 100. The portion of the outer connecting tube 232 exposed outside the formed section 120 may include a protrusion to be supported by an outer surface of the formed section 120 and outer surface of the rear plate 100. The hose sealing member 233 may be coupled to the outer connecting tube 232. The water supply hose 212 may be coupled to the hose sealing member 233. For example, the water supply hose 212 may extend through the portion of the outer connecting tube 232 exposed outside the formed section 120 of the rear plate 100 through the mounting hole 122*a* to an inner side of the formed section 120. The hose sealing member 233 may be made of a rubber material and, as such, seals the water supply hose 212.

Although the connecting tube 230 and water supply hose 212 may be installed outside the rear plate 100, they may not protrude more outward than the base section 110. This is because the connecting tube 230 and water supply hose 212 are installed at the formed section 120 protruding from the base section 110 toward the inner case 20.

Figure 8:
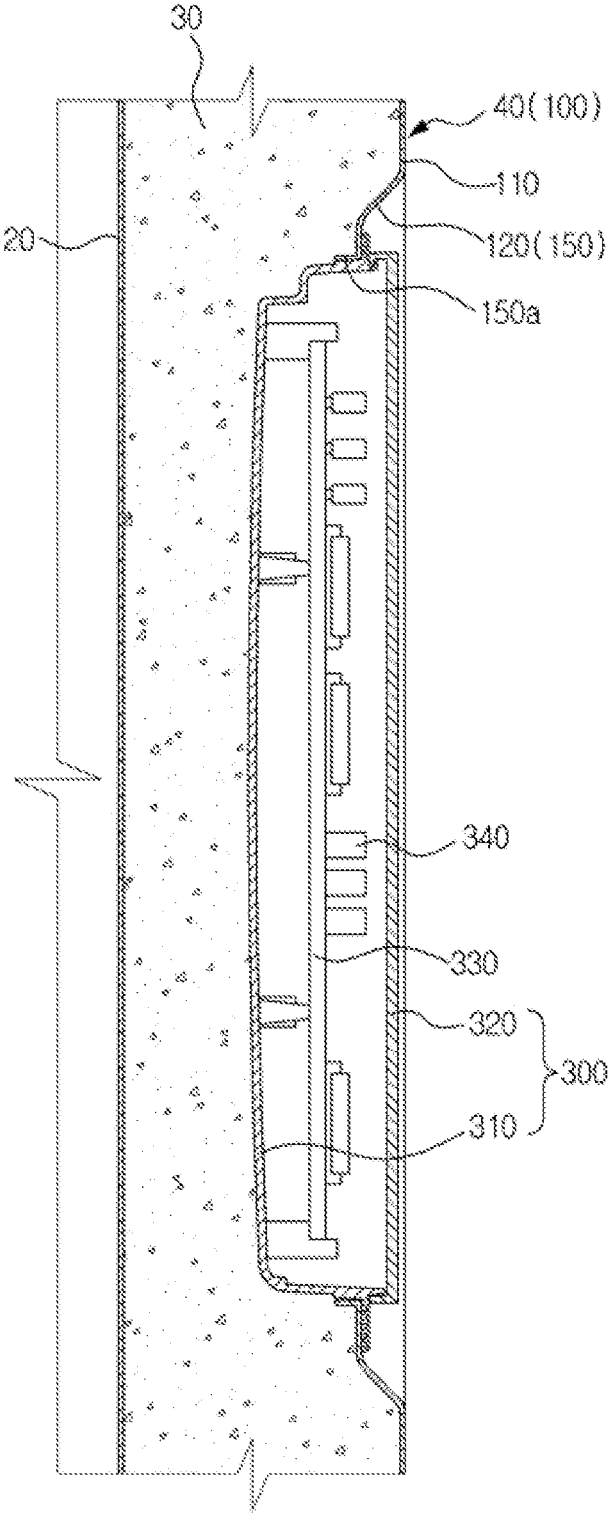
FIG. 8 is a sectional view explaining a structure in which an electric equipment box is coupled to the formed section of the rear plate in the refrigerator of FIG. 1.
Figure 9:
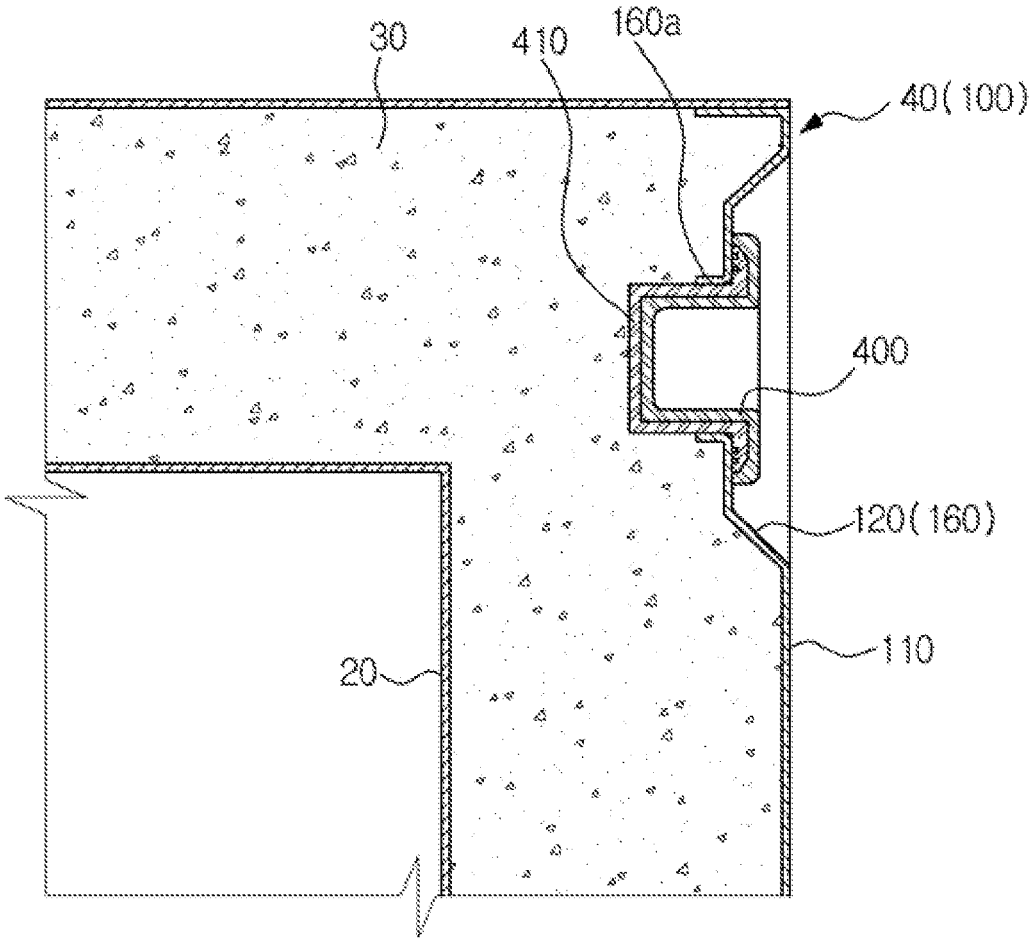
FIG. 9 is a sectional view explaining a structure in which a handle is coupled to the formed section of the rear plate in the refrigerator of FIG. 1.

FIG. 8 is a sectional view explaining a structure in which an electric equipment box is coupled to the formed section of the rear plate in the refrigerator of FIG. 1. FIG. 9 is a sectional view explaining a structure in which a handle is coupled to the formed section of the rear plate in the refrigerator of FIG. 1.

Hereinafter, an example of outer equipment in the refrigerator 1 according to an embodiment of the disclosure will be described with reference to FIGS. 1 to 9.

The outer equipment of the refrigerator 1 according to an embodiment of the disclosure may include an electric equipment box 300, in which electric equipment is received, and one or more handles 400 for movement of the refrigerator 1.

The electric equipment box 300 and handle 400 may be installed at the formed section 120 of the rear plate 100. Thus, the electric equipment box 300 and handle 400 may be indented or recessed with respect to the base section 110. As shown in FIGS. 3 and 4, two handles are disposed in formed sections which are disposed at upper left and upper right corners of the rear plate 100, respectively. The electric equipment box 300 may be disposed at lower side of the rear plate 100. However, the disclosure is not so limited. For example, there may be only one handle, or more than two handles, and the positioning of the handles may be at locations other than those shown in the figures (e.g., in an upper central location, at a central side location, etc.). Likewise, there may be more than one electric equipment box, and the positioning of the electric equipment box may be at a location other than that shown in the figures (e.g., in an upper central location, at a central side location, etc.).

The formed section 120 may include an electric equipment box installation portion 150 (FIG. 8), at which the electric equipment box 300 is installed, and a handle installation portion 160 (FIG. 9), at which the handle 400 may be installed. As described above, the formed section 120 may be formed to protrude from the base section 110 toward the inner case 20 through a foaming process.

Through holes 150*a* and 160*a* may be formed through the electric equipment installation portion 150 and handle installation portion 160, respectively. As such, the electric equipment box 300 and handle 400 may be installed through fitting thereof in respective through holes 150*a* and 160*a*.

The electric equipment box 300 may include a case 310 and a cover 320. A printed circuit board 330, on which electronic elements 340 may be mounted, may be received in the electric equipment box 300. The case 310 of the electric equipment box 300 may be fitted in the through hole 150*a* while being supported by the insulator 30. The cover 320 may be detachably coupled to the case 310 in order to open or close the case 310.

The electric equipment box 300 installed at the formed section 120 may not protrude more outward than the base section 110. Accordingly, it may be possible to reduce a possibility that the electric equipment box 300 is exposed to external physical impact, and to enhance space utility of the refrigerator.

A handle support member 410 may be fitted in the through hole 160*a* while being supported by the insulator 30. The handle 400 may be coupled to the handle support member 410. As shown in FIG. 9, the handle support member 410 may be disposed between the insulator 30 and the handle 400.

The handle 400 installed at the formed section 120 may not protrude more outward than the base section 110. Accordingly, space utility of the refrigerator may be enhanced.

As apparent from the above description, a formed section may be formed at a rear plate of an outer case of a refrigerator, to protrude toward an inner case, and outer equipment may be installed at the formed section. Accordingly, it is possible to protect outer equipment installed at the rear plate from external impact. An improvement in outer design of the refrigerator may also be achieved. The outer equipment may not protrude outward from the rear plate and, as such, no additional installation space is required.

In addition, since the formed section may be easily formed during pressing of the rear plate, cost and time may be reduced.

Although example embodiments of the disclosure have been shown and described, it would be appreciated by those skilled in the art that changes may be made to these embodiments without departing from the principles and spirit of the disclosure, the scope of which is defined in the claims and their equivalents.

What is claimed is:

1. A refrigerator, comprising:

an inner case comprising a rear wall having a first rear wall side facing toward a front of the refrigerator and a second rear wall side facing toward a rear of the refrigerator;

an outer case coupled to an outside of the inner case, the outer case comprising a rear plate having a first rear plate side facing the second rear wall side and a second rear plate side facing away from the second rear wall side, the second rear plate side being an external rear outer side of the refrigerator, visible from an outside of the refrigerator;

an insulator provided between the inner case and the outer case; and a storage chamber, open at a front side thereof, defined in the inner case, wherein the second rear plate side includes:

a base portion that is substantially flat such that the base portion lies in a first plane parallel to a second plane in which the second rear wall side lies, and a recessed portion that protrudes from the base portion toward the inner case to form a recess in the second rear plate side, and outer equipment is disposed in the recessed portion.

2. The refrigerator according to claim 1, wherein the rear plate is made of an iron plate material.

3. The refrigerator according to claim 1, wherein the outer equipment comprises a water supply hose to supply water.

4. The refrigerator according to claim 3, further comprising:

a water supply unit provided at the storage chamber, to supply water; and a water retrieval unit to receive water from the water supply unit, wherein the water supply hose supplies water from the water supply unit to the water retrieval unit.

5. The refrigerator according to claim 4, wherein the water supply unit comprises a water bucket provided at the storage chamber, to store water and to cool the stored water.

6. The refrigerator according to claim 4, wherein the water retrieval unit comprises an ice maker or a dispenser.

7. The refrigerator according to claim 3, further comprising:

a fixer coupled to the recessed portion, to fix the water supply hose.

8. The refrigerator according to claim 7, wherein the fixer comprises a support groove to support the water supply hose.

9. The refrigerator according to claim 7, wherein the fixer is coupled to the recessed portion by a fastening member.

10. The refrigerator according to claim 9, wherein the recessed portion comprises a fastening hole, to which the fastening member is fastened.

11. The refrigerator according to claim 3, wherein the outer equipment comprises a connecting tube that extends through the inner case, the insulator, and the rear plate, and is connected to the water supply hose.

12. The refrigerator according to claim 11, wherein the recessed portion includes a connecting tube installation hole extending through the recessed portion, for installation of the connecting tube at the recessed portion.

13. The refrigerator according to claim 1, wherein the outer equipment comprises an electric equipment box to receive electric equipment to control of operation of the refrigerator.

14. The refrigerator according to claim 13, wherein the recessed portion includes an electric equipment box installation hole extending through the formed section, for installation of the electric equipment box at the formed section.

15. The refrigerator according to claim 1, wherein the outer equipment comprises a handle to move the refrigerator.

16. The refrigerator according to claim 15, wherein the recessed portion includes a handle installation hole extending through the recessed portion, for installation of the handle at the recessed portion.

17. A refrigerator, comprising:

an inner case comprising a rear wall having a first rear side facing toward a front of the refrigerator and a second rear side facing toward a rear of the refrigerator;

an outer case coupled to an outside of the inner case, the outer case comprising a rear plate having a first rear plate side facing the second rear wall side and a second rear plate side facing away from the second rear wall side, the second rear plate side being an external rear outer side of the refrigerator, visible from an outside of the refrigerator;

an insulator provided between the inner case and the outer case;

a storage chamber, open at a front side thereof, defined in the inner case; and a water supply hose installed at the second rear plate side of the rear plate to supply water, wherein the second rear plate side comprises:

a base portion that is substantially flat such that the base portion lies in a first plane parallel to a second plane in which the second rear wall side lies, an introduction-side connecting tube installation portion which includes an introduction-side connecting tube, the water supply hose being connected, at one end thereof, to the introduction-side connecting tube, a discharge-side connecting tube installation portion which includes a discharge-side connecting tube, the water supply hose being connected, at an other end thereof, to the discharge-side connecting tube, a guide which connects the introduction-side connecting tube installation portion and the discharge-side connecting tube installation portion, and at least one of the introduction-side connecting tube installation portion, the discharge-side connecting tube installation portion, and the guide, protrude from the base portion toward the inner case to form at least one recess in the second rear plate side.

18. The refrigerator according to claim 17, further comprising:

a water supply unit provided at the storage chamber; and a water retrieval unit to receive water from the water supply unit, wherein the water supply hose supplies water from the water supply unit to the water retrieval unit.

19. The refrigerator according to claim 17, wherein the guide protrudes from the base portion toward the inner case to form the at least one recess in the second rear plate side, and the water supply hose connected to the introduction-side connecting tube and the discharge-side connecting tube is disposed in the at least one recess formed by the guide protruding from the base portion toward the inner case.

20. A refrigerator comprising:

an inner case comprising a rear wall having a first rear side facing toward a front of the refrigerator and a second rear side facing toward a rear of the refrigerator;

an outer case coupled to an outside of the inner case, the outer case comprising a rear plate having a first rear plate side facing the second rear wall side and a second rear plate side facing away from the second rear wall side, the second rear plate side being an external rear outer side of the refrigerator, visible from an outside of the refrigerator;

an insulator provided between the inner case and the outer case;

a storage chamber, open at a front side thereof, defined in the inner case; and a water supply hose installed at the second rear plate side of the rear plate to supply water, wherein the second rear plate side comprises:

a base portion that is substantially flat such that the base portion lies in a first plane parallel to a second plane in which the second rear wall side lies, and a recessed portion that protrudes from the base portion toward the inner case to form a recess in the second rear plate side, the water supply hose is installed in the recessed portion, such that the water hose is disposed between the recessed portion and the first plane, wherein a fixer is coupled to the recessed portion, to fix the water supply hose.

21. The refrigerator according to claim 20, further comprising:

a water supply unit provided at the storage chamber; and a water retrieval unit to receive water from the water supply unit, wherein the water supply hose supplies water from the water supply unit to the water retrieval unit.

22. A refrigerator, comprising:

an inner case comprising a rear wall having a first rear side facing toward a front of the refrigerator and a second rear side facing toward a rear of the refrigerator;

an outer case coupled to an outside of the inner case, the outer case comprising a rear plate having a first rear plate side facing the second rear wall side and a second rear plate side facing away from the second rear wall side, the second rear plate side being an external rear outer side of the refrigerator, visible from an outside of the refrigerator; and a storage chamber, open at a front side thereof, defined in the inner case, wherein the second rear plate side comprises:

a base portion that is substantially flat such that the base portion lies in a first plane parallel to a second plane in which the second rear wall side lies, and a recessed portion which is indented from the base portion toward the inner case to form a recess in the second rear plate side, and outer equipment installed at the recessed portion is disposed such that a first distance between the second rear side and the outer equipment is less than a second distance between the second rear side and the base portion.

23. The refrigerator according to claim 22, wherein the outer equipment includes a water hose, and the recessed portion includes:

a first mounting portion in which one end of the water hose is installed;

a second mounting portion in which an other end of the water hose is installed; and a guide which connects the first mounting portion and the second mounting portion, in which the water hose is disposed between the first mounting portion and the second mounting portion.

24. The refrigerator according to claim 22, wherein the outer equipment further includes electric equipment and a handle, and the recessed portion includes:

an electric equipment mounting portion in which the electric equipment is disposed; and a handle mounting portion in which the handle is disposed.

* * * * *